US005755600A

United States Patent [19]

Yoshida

[11] Patent Number: 5,755,600

[45] Date of Patent: May 26, 1998

[54] CONNECTOR WITH TERMINAL LOCKING MEMBER

[75] Inventor: Haruki Yoshida, Shizuoka, Japan

[73] Assignee: Yazaki Corporation, Tokyo, Japan

[21] Appl. No.: 660,280

[22] Filed: Jun. 7, 1996

[30] Foreign Application Priority Data

Jun. 9, 1995 [JP] Japan ..... 7-143309

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,044,991 | 9/1991 | Colleran et al. | 439/595 |
| 5,066,252 | 11/1991 | Kato et al. | 439/752 |
| 5,122,080 | 6/1992 | Hatagishi et al. | 439/595 |
| 5,186,662 | 2/1993 | Yuasa et al. | 439/752 |
| 5,224,883 | 7/1993 | Yamamoto | 439/752 |

FOREIGN PATENT DOCUMENTS

| | | |
|---|---|---|
| 515348 | 2/1993 | Japan . |
| 523440 | 3/1993 | Japan . |

*Primary Examiner*—Gary F. Paumen

*Attorney, Agent, or Firm*—Sughrue, Mion, Zinn, Macpeak & Seas, PLLC

[57] ABSTRACT

A connector housing has a locking member accommodating section having an insertion opening formed in one wall of the connector housing which communicates with terminal accommodating chambers, and an operation opening formed in a bottom wall of the connector housing. The terminal locking member is inserted into the locking member accommodating section through the insertion opening until the terminal locking member is temporarily locked. Thereafter the terminal locking member is pushed so as to be displaced normal to the terminal-locking-member inserting direction and the terminal inserting direction, thus being finally locked, whereby the terminal locking protrusions of the terminal locking member abuts against the shoulders of the terminals to secondarily lock the terminals.

3 Claims, 6 Drawing Sheets

CONNECTOR WITH TERMINAL LOCKING MEMBER

BACKGROUND OF THE INVENTION

1. Field of the invention

This invention relates to connectors which are used for electrically wiring automobiles, and more particularly to a connector with a terminal locking member which is adapted to prevent terminals inserted into the terminal accommodating chambers from coming off.

2. Related Art

An example of the connector of this type has been disclosed by Japanese Utility Patent Application No. 23440/1993. The connector thus disclosed is as shown in FIG. 8.

That is, in FIG. 8, reference numeral K designates the conventional connector, which is designed as follows:

A terminal locking member d is fitted in a cavity section c which is communicated with a plurality of terminal accommodating chambers b in a connector housing a, thereby to prevent female terminals e inserted into the terminal accommodating chambers b from coming off. That is, when the terminal locking member d is inserted into the cavity section c, the locking pieces f of the terminal locking member d are engaged with secondary locking pieces g of the female terminals e, thereby to positively lock the female terminals e.

The terminal locking member d is fitted in the connector housing a as follows: As shown in FIG. 9, the terminal locking member d is fitted in the cavity section c in advance in such a manner that the former is temporarily locked to the connector housing. After the female terminals e have been inserted into the terminal accommodating chambers, the terminal locking member d is pushed in the direction of the arrow in FIG. 10. As a result, as shown in FIG. 11, the terminal locking member is set at the final position so that the female terminals are finally locked in the connector housing a.

However, if, in temporarily locking the terminal locking member d in the cavity section, the worker firmly presses the terminal locking member d, then the latter d may be pushed to the aforementioned final position. In order to avoid this trouble, the worker is liable to push the terminal locking member with an inadequate amount of force. This may result in the difficulty that the terminal locking member is not temporarily locked in the cavity section, and accordingly in the following assembly step, the terminal locking member d may come off the connector housing, thus lowering the connector assembly efficiency.

SUMMARY OF THE INVENTION

In view of the foregoing, an object of the invention is to provide a connector in which the connector housing and the terminal locking member are improved so that, in assembling the connector, the temporary locking and the final locking of the terminal locking member are positively and readily achieved with high efficiency, and high reliability.

The foregoing object of the invention has been achieved by the provision of a connector in which terminals accommodated in terminal accommodating chambers are dual-locked to a connector housing with flexible locking arms formed in the terminal accommodating chambers, and a terminal locking member inserted into the connector housing through an insertion opening formed in a wall of the connector housing; in which, according to the invention, the connector housing has a locking member accommodating section having an insertion opening formed in a first wall of the connector housing which communicates with the terminal accommodating chambers, and an operation opening formed in a second wall of the connector housing which is adjacent to the first wall, the terminal locking member has terminal lead-in holes, and terminal locking protrusions, and a flexible protrusion, the terminal locking member is inserted into the locking member accommodating section through the insertion opening until the terminal locking member is temporarily locked with the flexible protrusions engaged with an edge portion of the insertion opening, and thereafter the terminal locking member is displaced across a terminal-locking-member inserting direction and a terminal inserting direction, thus being finally locked, and abutted against the terminals to lock the terminals.

Preferably, in the connector, the terminal locking member has locking protrusions, while protruded stripes are formed on walls of the locking member accommodating section to provide locking recesses therein, the locking protrusions being fitted in the locking recesses so that the terminal locking member is fixedly held in the locking member accommodating section.

The connector of the invention is assembled as follows: First, the terminal locking member is inserted into the connector housing from the side, thus being temporarily locked thereto. Thereafter, the terminal locking member is displaced across the terminal-locking-member inserting direction and the terminal inserting direction, thus being finally locked to the connector housing. That is, the temporary locking direction is different from the final locking direction. Hence, the worker will never make errors in the temporary locking operation and the final locking operation. This means that the probability is greatly reduced that errors will be made in assembling the connector, and the connector can be assembled with ease, thus raising productivity.

DETAILED DESCRIPTION OF THE PREFERRED EMBODIMENTS

Figure 1:
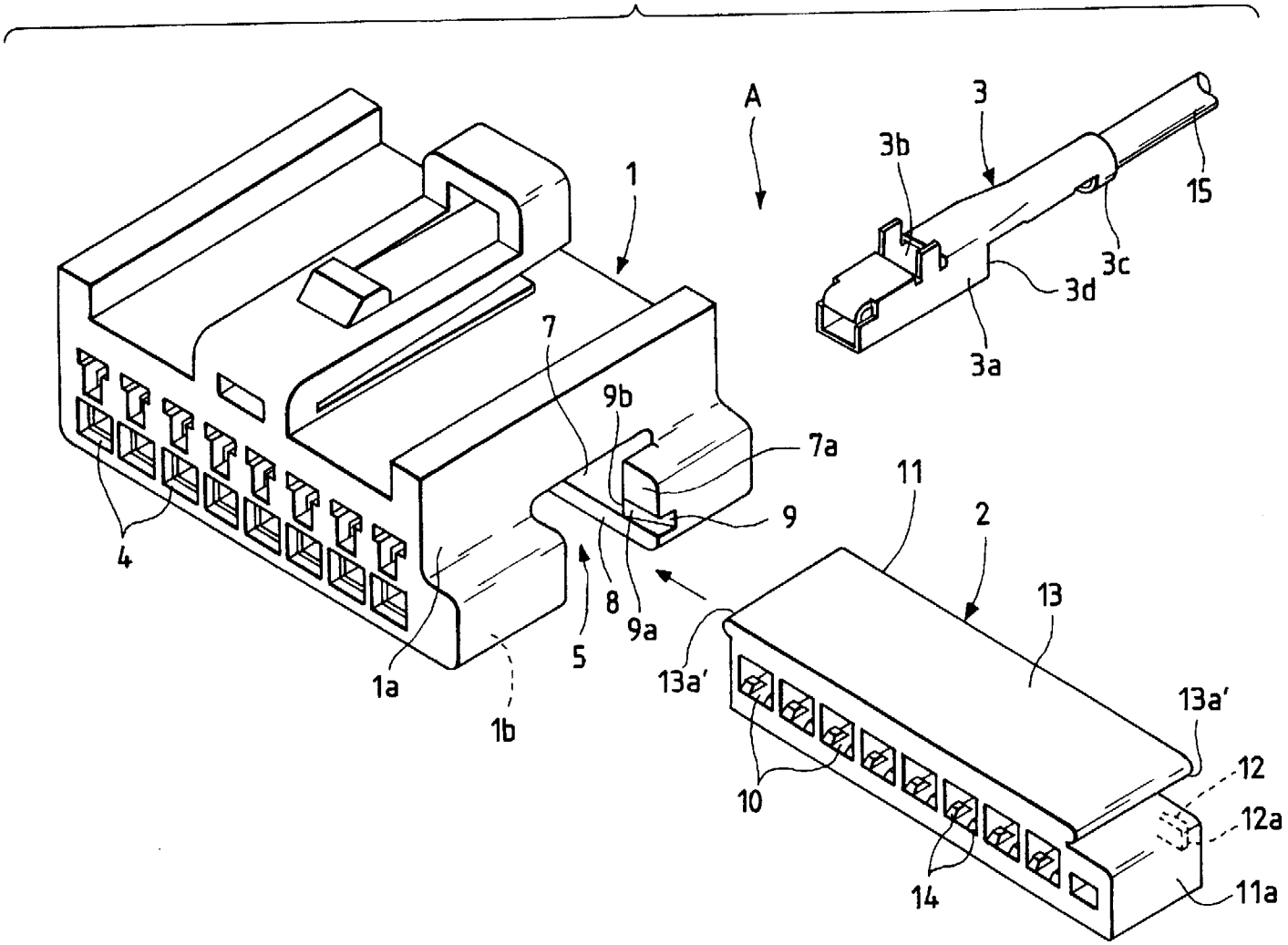
FIG. 1 is an exploded perspective view showing a connector with a terminal locking member, which constitutes a preferred embodiment of the invention.

FIG. 1 is an exploded perspective view showing a connector A with a terminal locking member 2 which constitutes a preferred embodiment of the invention.

The connector A includes: a connector housing 1 formed by molding electrically insulating synthetic resin; the terminal locking member 2 which is detachably engaged with the connector housing 1; and terminals 3 which are accommodated in the connector housing 1.

Figure 2:
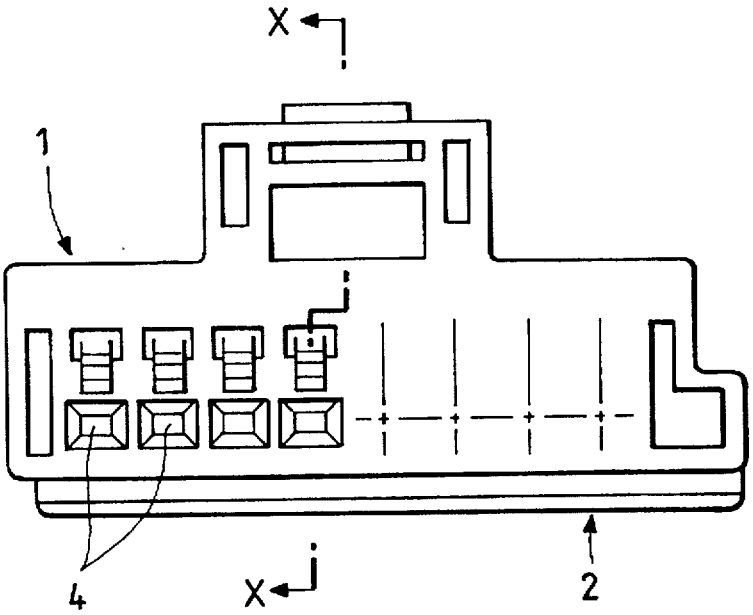
FIGS. 2 and 3 are a front view and a side view, respectively, showing the terminal locking member which is temporarily locked to a connector housing.
Figure 3:
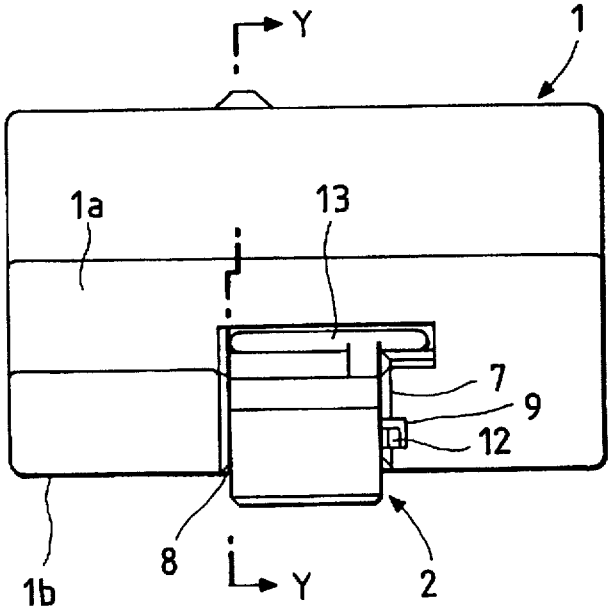

FIGS. 2 and 3 are a front view and a side view, respectively, showing the terminal locking member 2 engaged with the connector housing 1 and temporarily locked to the latter 1.

Figure 5:
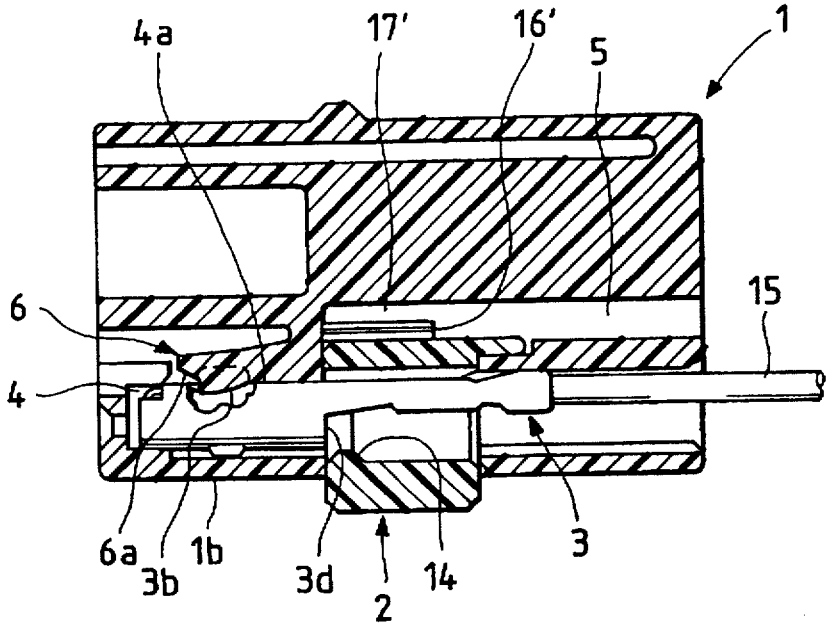
FIG. 5 is a sectional view taken along line Y—Y in FIG. 3.
Figure 6:
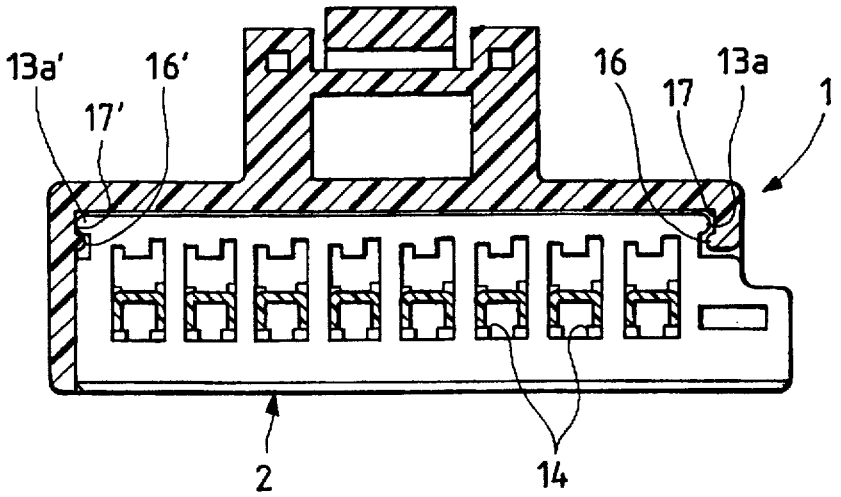
FIG. 6 is a front view showing the terminal locking member illustrated in FIG. 2 which is finally locked to the connector housing.
Figure 7:
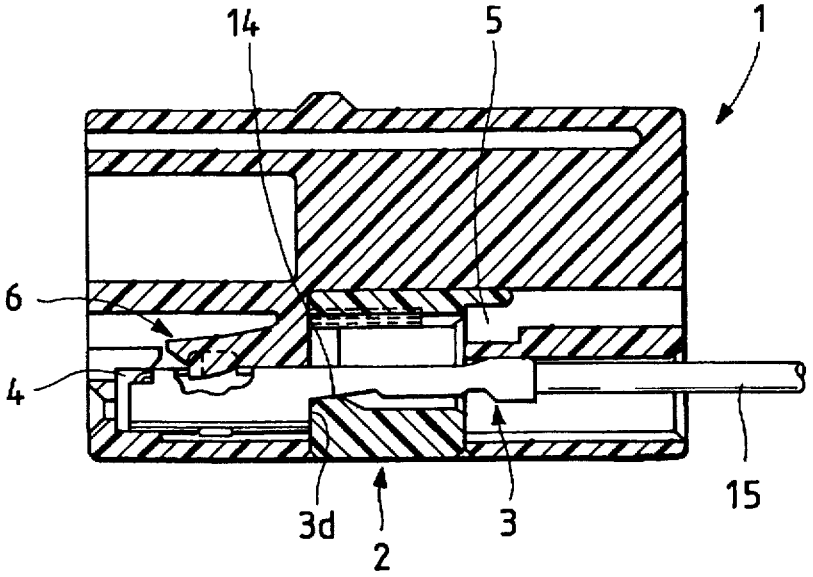
FIG. 7 is a longitudinal sectional view showing the connector housing and the terminal locking member illustrated in FIG. 6.
Figure 8:
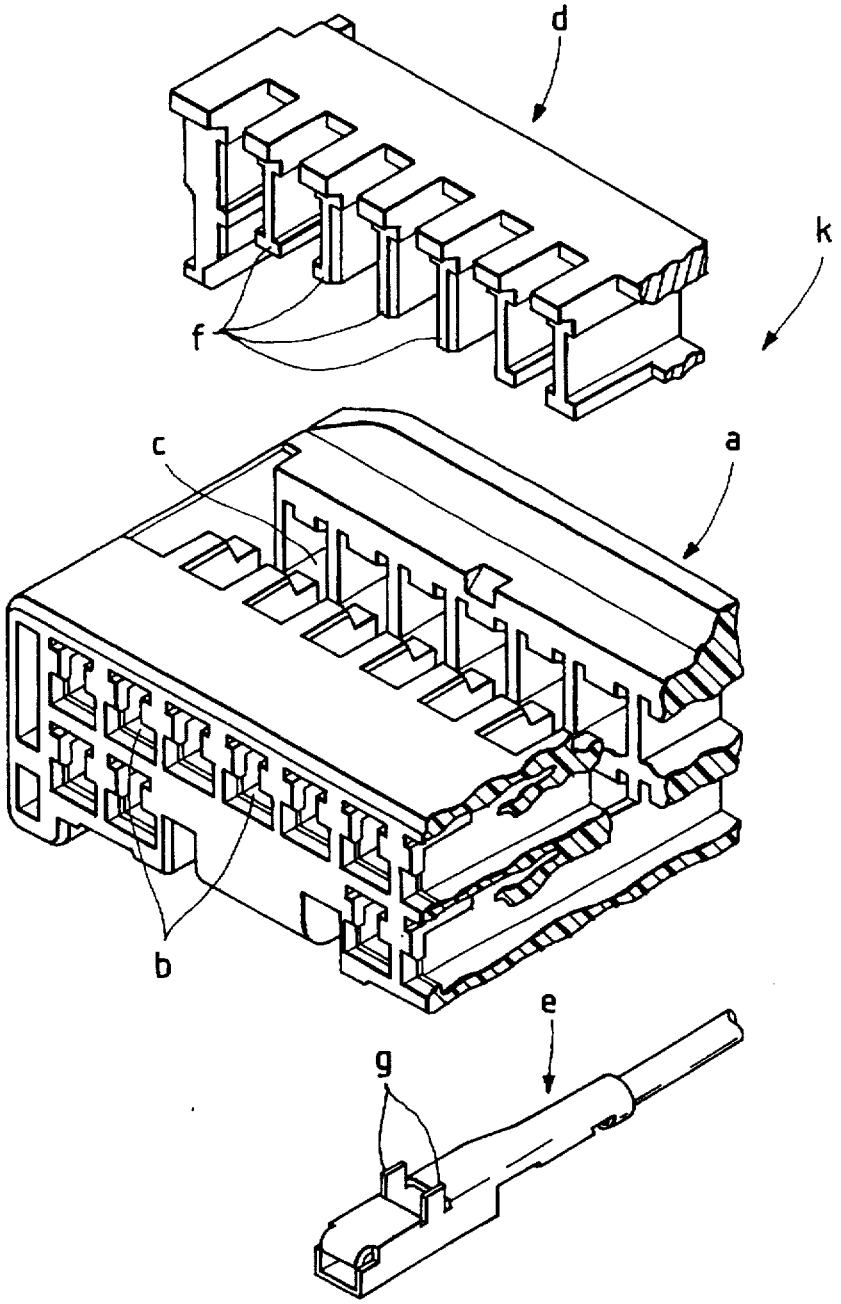
FIG. 8 is an exploded perspective view showing a conventional connector with a terminal locking member.
Figure 9:
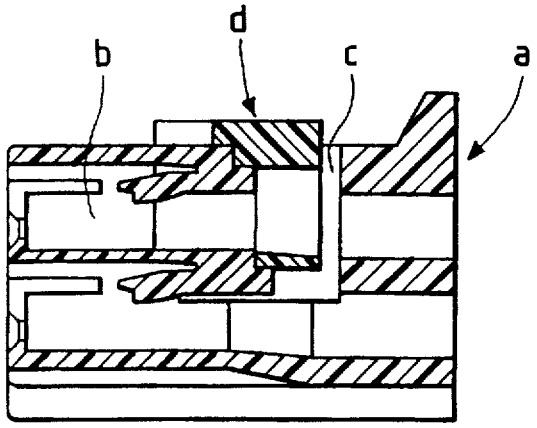
FIG. 9 is a sectional view showing the terminal locking member engaged with the cavity section of the connector housing, thus being temporarily locked to the latter.
Figure 10:
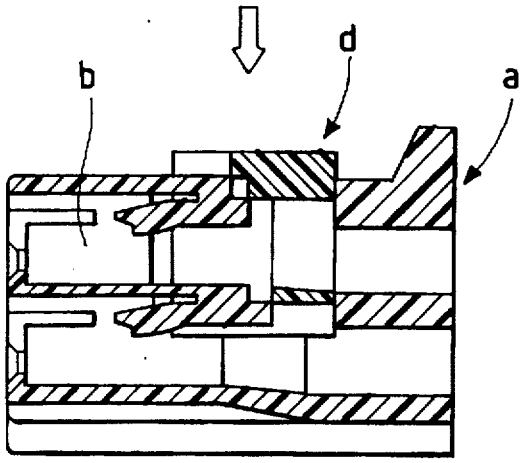
FIG. 10 is a sectional view showing the terminal locking member (illustrated in FIG. 9) being pushed so as to be finally locked to the connector housing.
Figure 11:
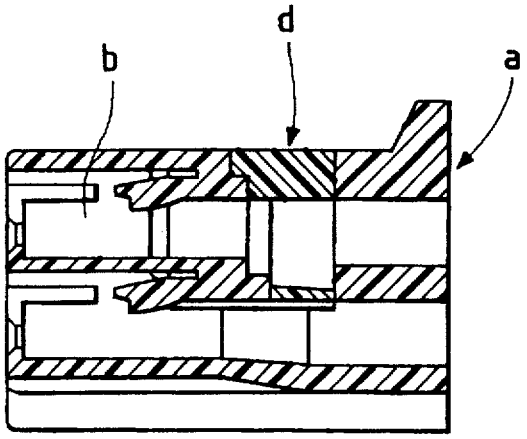
FIG. 11 is a sectional view showing the terminal locking member finally locked to the connector housing.

The connector housing 1 is a male type connector housing which is engaged with a mating connector housing of female type. The connector housing 1 has a plurality of terminal accommodating chambers 4 which are juxtaposed, and opened both in the front and in the rear of the housing 1. In the rear end portions of the terminal accommodating chambers, a locking member accommodating section 5 is formed to receive the terminal locking member 2. On the inner surface 4*a* of each of the terminal accommodating chambers 4, a flexible locking arm 6 is formed in such a manner that it is extended towards the mating connector (as shown in FIG. 5).

The locking member accommodating section 5 has an insertion opening 7, and an operation opening 8. The insertion opening 7 is opened in one side wall 1*a* of the connector housing 1, and the operating opening 8 is formed by cutting the bottom wall 1*b* (adjacent to the side wall 1*a*). A guide groove 9 is formed in the edge portion 7*a* of the insertion opening 7.

The terminal locking member 2 is a frame having a plurality of terminal lead-in holes 10 in correspondence to the terminal accommodating chambers 4. The terminal locking member 2 is engaged with (fitted in) the connector housing 1 through the insertion opening 7

The frame 11 has a flexible protrusion 12 on its one end 11*a*, which is brought into contact with a taper portion 9*a* of the guide groove 9 formed in the edge portion 7*a* of the insertion opening 7.

The frame 11 has a guide wall 13 above the terminal lead-in holes 10 to guide the terminal locking member 2 into the insertion opening 7 and to lock the terminal locking member 2 to the connector housing.

Both end portions of the guide wall 13 are formed into locking protrusions 13*a* and 13*a*'. Terminal locking protrusions 14 are formed on the bottom surface of the front portion of each of the terminal lead-in holes 10 in the frame 11.

Each of the terminals 3 has a female type electrical contact section 3*a*. The latter 3*a* has a locking hole 3*b* which is engaged with the flexible locking arm 6 (FIG. 5) of the terminal accommodating chamber. The rear end portion of the terminal 3 is a wire connecting section 3*c*, which is crimped over an electric wire so that the terminal 3 is connected to the wire.

Now, a connector assembling operation in which the terminal locking member 2 is engaged with the connector housing 2, and the terminals 3 are locked thereto, will be described.

Figure 4:
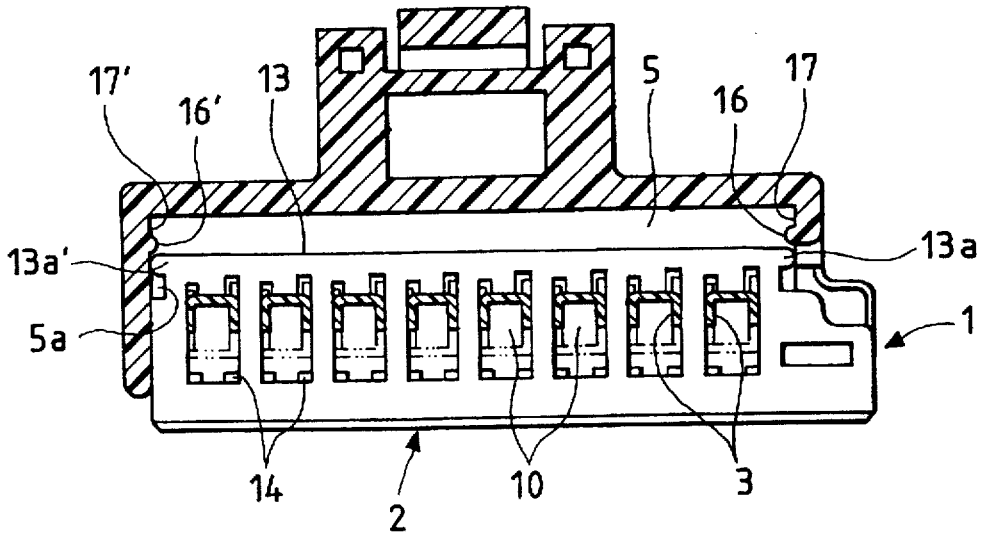
FIG. 4 is a sectional view taken along line X—X in FIG. 2.

First, the terminal locking member 2 is inserted into the insertion opening 7 of the connector housing 1 as indicated by the arrow in FIG. 1, and the terminal locking member 2 is positioned as shown in FIG. 4. In this operation, the flexible protrusion 12 of the terminal locking member 2 is inserted into the locking member accommodating section 5 while being elastically in contact with the taper portion 9*a* of the guide groove 9 formed in the edge portion 7*a* of the insertion opening 7. The free end portion 12*a* of the flexible protrusion 12 is abutted against the end 9*b* of the guide groove 9, so that the terminal locking member 12 is temporarily locked. In this case, the terminal locking protrusions 14 of the frame 11 are yet located (exposed) outside the operating opening 8.

When the terminal locking member 2 is engaged with the locking member accommodating chamber 5 and temporarily locked to the connector housing in the above-described manner, the terminals 3 are inserted into the terminal accommodating chambers as shown in FIG. 5. In this operation, each terminal 3 reaches a predetermined position in the terminal accommodating chamber 4 through the terminal lead-in hole 10, and the locking piece 6*a* of the flexible locking arm 6 is fitted in the locking hole 3*b* of the terminal 3; that is, the latter 3 is primarily locked to the connector housing.

Thereafter, the terminal locking protrusions 14 located outside the operation opening 8 are pushed as indicated by the arrow in FIG. 4. As a result, the locking protrusions 13*a* and 13*a*'of the guide wall 13 of the terminal locking member are caused to move over protruded ribs 16 and 16' formed on the peripheral walls 5*a* of the locking member accommodating section and engage with locking recesses 17 and 17'. As a result, the terminal locking member 2 is completely engaged with the locking member accommodating section 5 and locked to the connector housing.

In this operation, the terminal locking protrusions 14 of the terminal locking member 2 are positioned behind the shoulder 3*d* of each terminal 3; that is, the terminal locking protrusions abut against the shoulder 3*d*. Thus, the terminal 3 is secondarily locked, thus being positively prevented from coming off the connector.

With the connector of the invention, the temporary locking operation of the terminal locking member is different in direction from the final locking operation of the same terminal locking member, and therefore the worker will never make an error in the temporary locking operation and the final locking operation. This means that the probability is greatly reduced that errors will be made in assembling the connector, and the connector can be assembled with ease and high productivity.

What is claimed is:

1. A connector comprising:

a connector housing including a locking member accommodating section having:

an insertion opening formed in a first wall of said connector housing which communicates with terminal accommodating chambers provided in said connector housing; and a terminal locking member including terminal lead-in holes, terminal locking protrusions, and a locking means, wherein said terminal locking member is insertable into said locking member accommodating section through said insertion opening in a terminal locking member insertion direction normal to a terminal inserting direction until said terminal locking member is temporarily locked with said locking means engaged with said connector housing, and said terminal locking member is displaceable normal to said terminal-locking-member inserting direction and said terminal inserting direction to finally lock said terminal locking member, and abut said terminal locking protrusions against said terminals to lock said terminals in said terminal accommodating chambers.

2. A connector as claimed in claim 1, wherein said terminal locking member has external locking protrusions ribs, protruded are formed on walls of said locking member accommodating section to provide locking recesses therein, and said external locking protrusions are fitted in said locking recesses so that said terminal locking member is fixedly held in said locking member accommodating section.

3. The connector as claimed in claim 1, wherein said locking means comprises a flexible protrusion engageable with an edge portion of said insertion opening.

* * * * *